US006981921B2

(12) United States Patent
Scott et al.

(10) Patent No.: US 6,981,921 B2
(45) Date of Patent: Jan. 3, 2006

(54) TRAINING DEVICE

(76) Inventors: Kenneth A. Scott, 10669 E. Acoma Dr., Scottsdale, AZ (US) 85259; Matthourasy S. Soubannarath, 8153 E. Rovey Ave., Scottsdale, AZ (US) 85250

( * ) Notice: Subject to any disclaimer, the term of this patent is extended or adjusted under 35 U.S.C. 154(b) by 0 days.

(21) Appl. No.: 10/256,535

(22) Filed: Sep. 27, 2002

(65) Prior Publication Data

US 2004/0063512 A1 Apr. 1, 2004

(51) Int. Cl.
*A63B 53/06* (2006.01)
*A63B 53/16* (2006.01)
*A63B 69/36* (2006.01)

(52) U.S. Cl. ..... 473/262; 473/257

(58) Field of Classification Search ..... 473/261, 473/262, 265, 266, 267, 278, 313, 406, 407, 473/176

See application file for complete search history.

(56) References Cited

U.S. PATENT DOCUMENTS 3,578,333 A * 5/1971 Elesh ..... 473/171
3,649,029 A * 3/1972 Worrell ..... 473/251
3,735,988 A * 5/1973 Palmer et al. ..... 473/162
3,843,136 A * 10/1974 Buenzle ..... 473/162
3,880,432 A * 4/1975 Coffey et al. ..... 473/278
3,934,874 A * 1/1976 Henderson ..... 473/265
4,108,440 A * 8/1978 Delaplaine ..... 473/160
4,805,912 A * 2/1989 Hickman ..... 473/159
4,826,174 A * 5/1989 Hoyt, Jr. ..... 473/157
4,966,370 A * 10/1990 Morris ..... 473/159
5,004,243 A * 4/1991 Dlouhy ..... 473/279
5,131,659 A * 7/1992 Lindberg, Jr. ..... 473/267
5,205,559 A * 4/1993 Plopper ..... 473/179
5,294,124 A * 3/1994 Florian ..... 473/267
5,319,548 A * 6/1994 Germain ..... 700/92
5,429,368 A * 7/1995 Adams ..... 473/162
5,443,870 A * 8/1995 Lurie et al. ..... 428/17
5,478,071 A * 12/1995 Barrs et al. ..... 473/176
5,630,719 A * 5/1997 Franklin ..... 434/252
6,110,053 A * 8/2000 Sjoblom ..... 473/179
6,196,929 B1 * 3/2001 Erodes et al. ..... 473/160
6,338,682 B1 * 1/2002 Torchia et al. ..... 473/160
6,638,173 B2 * 10/2003 Robinson ..... 473/131
6,739,980 B2 * 5/2004 Scott et al. ..... 473/200

* cited by examiner

*Primary Examiner*—Gregory Vidovich
*Assistant Examiner*—M. Chambers
(74) *Attorney, Agent, or Firm*—Robert Ryan Morishita; Morishita Law Firm, LLC

(57) ABSTRACT

A training device is provided for teaching the proper technique for the putting of a golf ball. The training device includes a putting surface having contours therein and a cup for receiving a golf ball. A tee box is provided on the putting surface. The tee box has ball placement indicia for placing a golf ball thereon, a length generally equal to a desired length of a stroke of the putter necessary to putt the golf ball from the ball placement indicia into the cup in the putting surface, and a width generally equal to the width of the putter. Roll path indicia on the putting surface identifies a roll path for the golf ball as it travels between the ball placement indicia and the cup in the putting surface.

24 Claims, 3 Drawing Sheets

TRAINING DEVICE

FIELD OF THE INVENTION

This invention generally relates to the game of golf, and in particular, to a training device for teaching an individual the mechanics and skills associated with the putting of a golf ball with a putter.

BACKGROUND AND SUMMARY OF THE INVENTION

As is known, the putting of a golf ball is a vital aspect of the game of golf. A golfer who consistently uses the proper fundamentals when putting greatly increases the probability that each putt taken by the golfer will end up in the cup. It can be appreciated that there are many aspects to a proper putting stroke. For example, the proper length of the backswing and the follow through of a putter in relation to the distance of the putt to be taken, the speed of the putting surface, and the contours in the putting surface is imperative for an accurate putt. Further, the development of a consistently fluid, pendulum-like putting stroke that is easily repeatable greatly increases the likelihood of an accurate putt. Likewise, the development of the skill of reading the correct and accurate line of a putt in relation to the putt distance, the speed of putting surface, and the contours in the putting surface also increases the putting ability of a golfer.

Heretofore, the options available to a golfer to learn the proper fundamentals for putting a golf ball have been limited. For example, the golfer may hire an instructor to teach him or her the finer points of a proper putting stroke. However, it can be appreciated that the instructions provided by the instructor may be forgotten after completion of the golf lesson. In addition, a golf lesson is often time consuming and very expensive. Alternatively, golfers often purchase new putters in an attempt to improve the accuracy of their putts. However, without the development of the fundamental skills necessary to accurately putt a golf ball, the change of equipment will yield minimal results.

Therefore, it is a primary object and feature of the present invention to provide a training device that teaches the fundamentals necessary for developing an easily repeatable pendulum-like putting stroke.

It is a further object and feature of the present invention to provide a training device that teaches a golfer the proper eye and hit positions relative to the proper roll path of a putt.

It is a still further object and feature of the present invention to provide a training device that teaches a golfer the proper length of the backswing and follow through necessary in relation to the distance of a putt, the speed of the putting surface, and the contours in the putting surface.

It is a still further object and feature of the present invention to provide a training device that teaches a golfer the skill of reading the correct and accurate line of a putt in relation to the distance of the putt, the speed of the putting surface, and the contours in the putting surface.

In accordance with the present invention, a training device is provided for teaching the putting of a golf ball with a putter. The putter has a head with a length, width and a ball striking surface. The training device including a putting surface having an opening therein for receiving the golf ball. The opening has a predetermined diameter. A tee box is provided on the putting surface. The tee box has ball placement indicia for positioning the golf ball thereon and a length generally equal to the desired length of a stroke of a putter necessary to putt the golf ball from the ball placement indicia to the opening in the putting surface.

The tee box has a width generally equal to the width of the putter. First and second tee receiving openings may be positioned on the opposite sides of the tee box. Tees are receivable in corresponding tee receiving openings for defining a putter path therebetween. A reflective surface may be affixed to the tee box at a location axially spaced from the ball placement indicia by a predetermined length. The predetermined length between the reflective surface and the ball placement indicia is generally equal to the width of the putter head.

A cup may be inserted in the opening in the putter surface. The cup has an outer diameter generally equal to the diameter to the opening in the putting surface. The cup defines a cup opening for receiving the golf ball therein. In addition, a pad may be positioned under the putting surface to provide a contour in the putting surface. The contour has an upslope and a downslope. The upslope of the contour may be indicated by upslope indicia on the putting surface and the downslope of the contour may indicated by downslope indicia on the putting surface. Roll path indicia may be provided on the putting surface for defining a roll path for the golf ball between the ball placement indicia and the opening in the putting surface. A border may extend along at least a portion of the outer periphery of the putting surface to maintain the golf ball thereon.

In accordance with a further aspect of the present invention, a training device is provide for teaching the putting of a golf ball with a putter. The putter has a head with a length, a width and a ball striking surface. The training device includes a putting surface having an opening therein for receiving the golf ball. The opening has a predetermined diameter. A tee box is provided on the putting surface. The tee box has a ball placement indicia for positioning the golf ball thereon. A reflective surface is positioned a predetermined length behind the ball placement indicia.

The tee box has first and second sides and a length generally equal to a desired length of a stroke of the putter necessary to putt the golf ball from the ball placement indicia into the opening in the putting surface. The tee box also includes a width generally equal to the width of the putter.

A cup insert is receivable in the opening in the putting surface. The cup insert has an outer diameter generally equal to the diameter of the opening in the putting surface and defines a cup opening for receiving the golf ball therein. The putting surface also includes a contour therein. The contour has an upslope and a downslope. A plurality of roll path indicia is provided on the putting surface. The roll path indicia is spaced along a roll path between the ball placement indicia and the opening in the putting surface.

In accordance with a further aspect of the present invention, a training device is provided for teaching the putting of a golf ball with a putter. The putter has a head with a length, a width and a ball striking surface. The training device includes a putting surface having a contour and an opening therein. The contour has an upslope and a downslope. The opening is capable of receiving the golf ball and is of a predetermined diameter. The training device further includes a tee box on the putting surface. The tee box has a ball placement indicia for positioning the golf ball thereon, a length generally equal to a desired length of a stroke of the putter necessary to putt the golf ball from the ball placement indicia into the opening in the putting surface, and a width generally equal to the width of the putter. Roll path indicia is provided on the putting surface for identifying a roll path for the golf ball between the ball placement indicia and the opening in the putting surface. A reflective surface is positioned a predetermined length behind the ball placement indicia.

It is contemplated to provide a cup insert that is receivable in the opening of the putting surface. The cup insert has an outer diameter generally equal to the diameter of the opening in the putting surface. The cup insert defines a cup opening for receiving the golf ball therein. Upslope indicia may be provide on the upslope of the contour of the putting surface and downslope indicia may be provided on the downslope of the contour of the putting surface.

BRIEF DESCRIPTION OF THE DRAWINGS

The drawings furnished herewith illustrate a preferred embodiment of the present invention in which the above advantages and features are clearly disclosed. Other advantages and features will also be apparent from the following detailed description.

In the drawings.

DETAILED DESCRIPTION OF THE INVENTION

Figure 1:
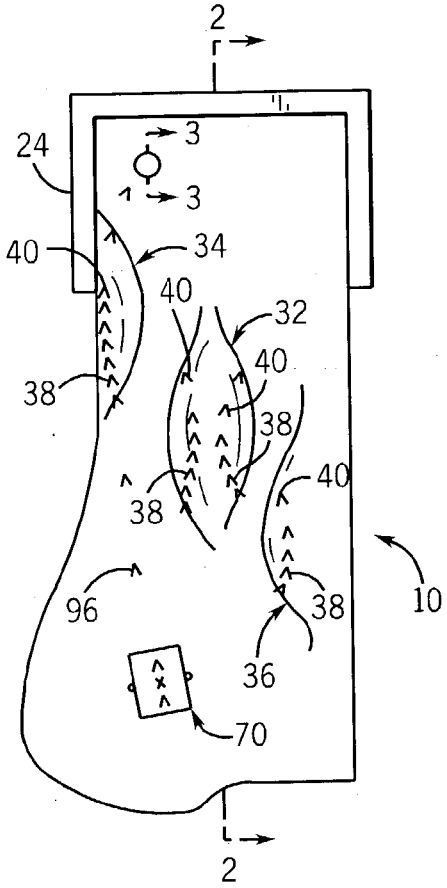
FIG. 1 is a top plan view of the putting device in accordance with the present invention.

Referring to FIG. 1, a training device in accordance with the present invention is generally designated by the reference numeral 10. It is intended that training device 10 be used in conjunction with the golf ball and the putter fully described in U.S. patent application, Ser. No. 10/143,587, now U.S. Pat. No. 6,739,980, entitled "Golf Aiming And Alignment System and Method" that is assigned to the assignee of the present invention and incorporated herein by reference. Specifically, as described in U.S. Pat. No. 6,739,980, the training device may be used with a golf ball bearing a pattern of directional indicia laid out in a straight line along the circumference of the golf ball around its equator. A putter also bears directional indicia. In this case, the indicia are located on the head of the putter so they are visible during putting. Indicia are placed so that they point to the proper impact zone on the putter face, i.e. the ball striking surface. However, it can be appreciated that training device 10 may be used with a conventional golf ball 13 and/or a conventional putter 15 without deviating in scope of the present invention.

Figure 2:
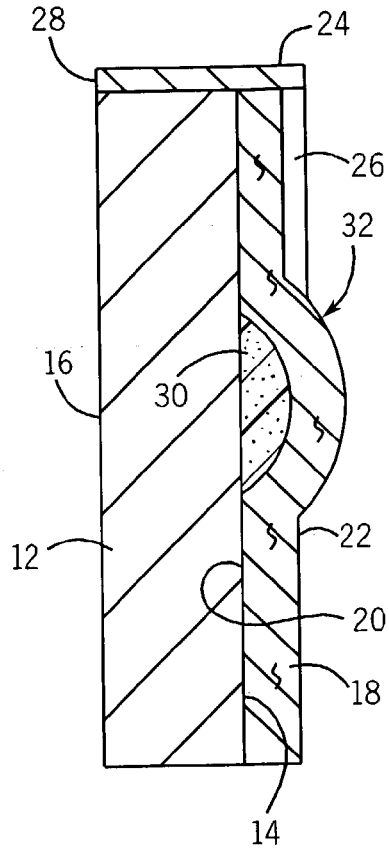
FIG. 2 is a cross-sectional view of the putting device of the present invention taken along line 2—2 of FIG. 1.
Figure 3:
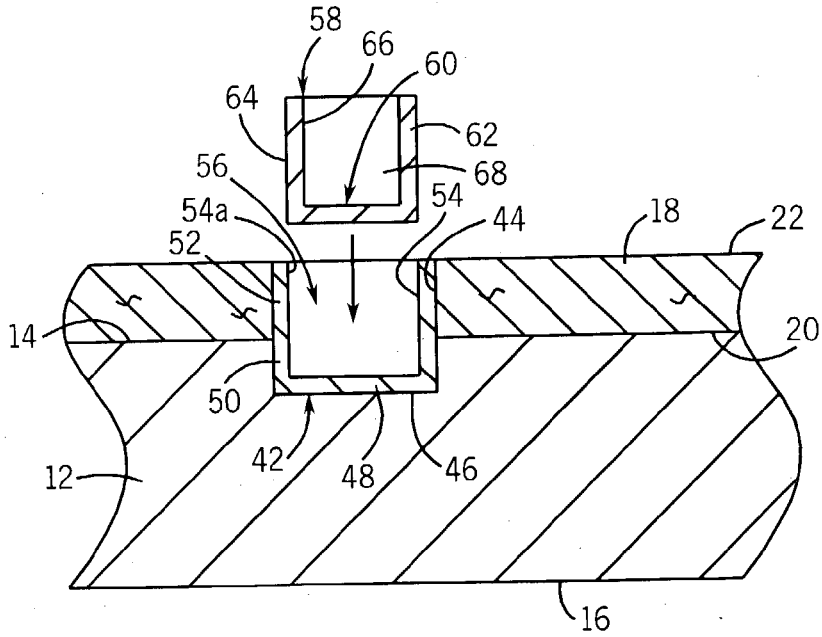
FIG. 3 is a cross-sectional view of the training device of the present invention taken along line 3—3 of FIG. 1.

Training device 10 includes base 12 having an upper and lower surfaces 14 and 16, respectively, FIG. 2. It is intended that lower surface 16 of base 12 be positioned on a supporting surface such as the ground, a floor or the like. Upper surface 14 of base 12 is generally planar and is adapted for receiving putting mat 18 thereon. Putting mat 18 includes a lower surface 20 that may be affixed to upper surface 14 of base 12 in any conventional manner and an upper surface 22 for receiving golf ball 13 thereon. Border 24 extends about at least a portion of the outer peripheries of base 12 and putting mat 18 to maintain a putted golf ball 13 on upper surface 22 of putting mat 18 during use of training device 10. Border 24 includes an upper portion 26 that projects vertically from upper surface 22 of putting mat 18 and a lower edge 28 that is generally co-planar with lower surface 16 of base 12. It is contemplated that border 24 be removable from the outer peripheries of base 12 and putting mat 18 if so desired by the user.

Pad 30 may be positioned between upper surface 14 of base 12 and lower surface of putting mat 18 so as to form contour 32 in upper surface 22 of putting mat 18. Pad 30 may be formed from a resilient loam or similar type of material. It can be understood the shape of contour 32 in upper surface 22 of putting mat 18 corresponds to the shape of pad 30. Further, it can be appreciated that additional pads may be used to form other contours 34 and 36 in upper surface 22 of putting mat 18. The shapes of pads 30 may differ in order that contours 32, 34 and 36 in upper surface 22 of putting mat 18 may provide various slopes and breaks in upper surfaces 22 of putting mat 18.

Upslope indicia 38 may be provided of the upslopes in upper surfaces 22 of putting mat 18 to provide a visual representation of the upslope of contours 32, 34 and 36 for the user. Similarly, downslope indicia 40 may be provided on the downslopes of contours 32, 34 and 36 in upper surfaces 22 of putting mat 18 to provide a visual representation of the downslopes for the use of contours 32, 34 and 36 of training device 10. By way of example, upslope indicia 38 and downslope indicia 40 may take the form of arrowheads. It is contemplated that the spacing, between the arrowheads provided in upslope indicia 38 be less than the spacing between the arrowheads in downslope indicia 40 so as to allow a user to quickly visualize the upslopes and downslopes of contours 32, 34 and 36. It can be appreciated that other types of symbols and/or spacing may be used for upslope indicia 38 and downslope indicia 40 on contours 32, 34 and 36, without deviating from the scope of the present invention.

Training device 10 further includes cup 42 that is receivable in opening 44 through putting mat 18. Cup 42 includes a first closed end 46 seated within recess 48 formed in upper surface 14 of base 12. Vertical wall 50 of cup 42 includes an outer surface 52 and an inner surface 54 that defines cylindrical ball receiving volume 56. The outer diameter of vertical wall 50 is generally equal to the diameter of opening 44 in putting mat 18 and the inner diameter of vertical wall 50 is generally equal to the diameter of a conventional cup in the green of a golf hole. Upper edge 54*a* of inner surface 54 of vertical wall 50 defines an opening for allowing golf ball 13 to roll off of upper surface 22 of putting surface 18 into ball receiving volume 56 in cup 42. Cup insert 58 may be inserted into ball receiving volume 56 defined by cup 42. Cup insert 58 includes a closed end 60 and a vertical wall 62 projecting therefrom. Vertical wall 62 of cup insert 58 includes an outer surface 64 that forms a mating relationship with inner surface 54 of vertical wall 50 of cup 42 and an inner surface 66 that defines a golf ball receiving void 68. Golf ball receiving void 68 in cup insert 58 has a diameter less than the diameter of a regulation cup in a green of a golf hole but greater than the diameter of golf ball 13. It can be appreciated that additional cup inserts having smaller diameters may be positioned within cup insert 58 to further reduce the size of golf ball receiving void 68.

Figure 4:
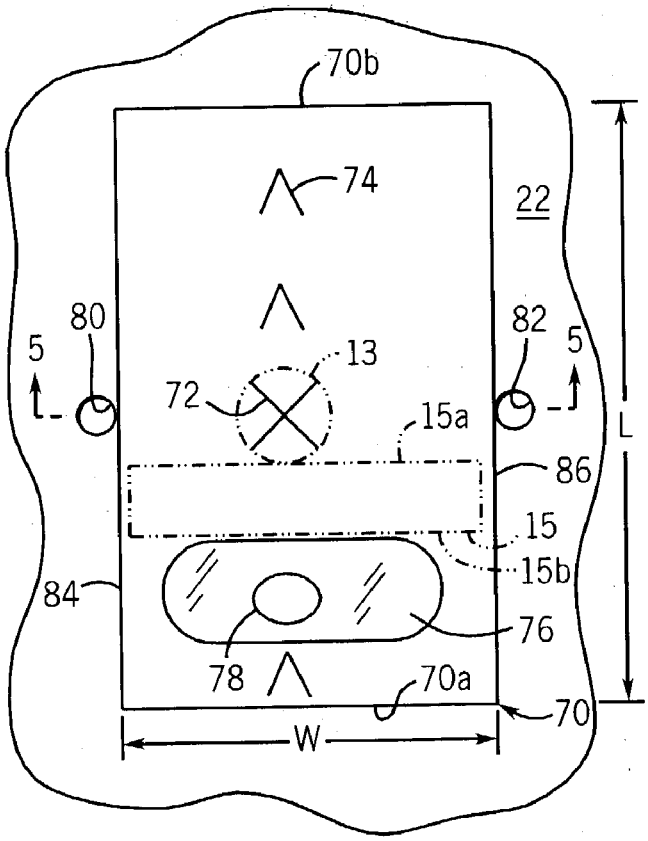
FIG. 4 is an enlarged, top plan view showing a portion of the training device of FIG. 1.

Referring to FIG. 4, training device 10 further includes tee mat 70 on upper surface 22 of putting mat 18. Tee mat 70 may be imprinted on upper surfaces 22 of putting mat 18 or may be affixed to upper surfaces 22 of putting mat 18. Tee mat 70 includes ball placement indicia 72 that identifies a position for placement of golf ball 13. Tee mat 70 has a length L generally equal to the length of a putting stroke necessary to putt golf ball 13 positioned on ball placement indicia 72 to ball receiving volume 56 in cup 42 given the distance of the putt, the speed of upper surface 22 of putting mat 18, and contours 32, 34 and 36 in upper surface 22 of putting mat 18. A putting stroke is defined by the length of a backswing and the length of the follow through required. The width W of tee mat 70 is generally equal to the length of conventional putter 15.

Tee mat 70 further includes aiming indicia 74 that indicate the proper direction golf ball 13 must be putted for such golf ball to roll along upper surface 22 of putting mat 18 into ball receiving volume 52 in cup 42. Reflective surface 76 is positioned a predetermined distance behind ball placement indicia 72 and may take the form of an element removably positioned on putting mat 18, fixed to putting mat 18, or incorporated into putting mat 18. It is contemplated that reflective surface 76 be positioned behind ball placement indicia 72 a distance generally equal to the width of conventional putter 15. Reflective surface 76 includes a eye-shaped reflecting portion 78 that allows a user to have a visual indication that the user's eyes are in proper position for putting golf ball 13 towards cup 42.

Figure 5:
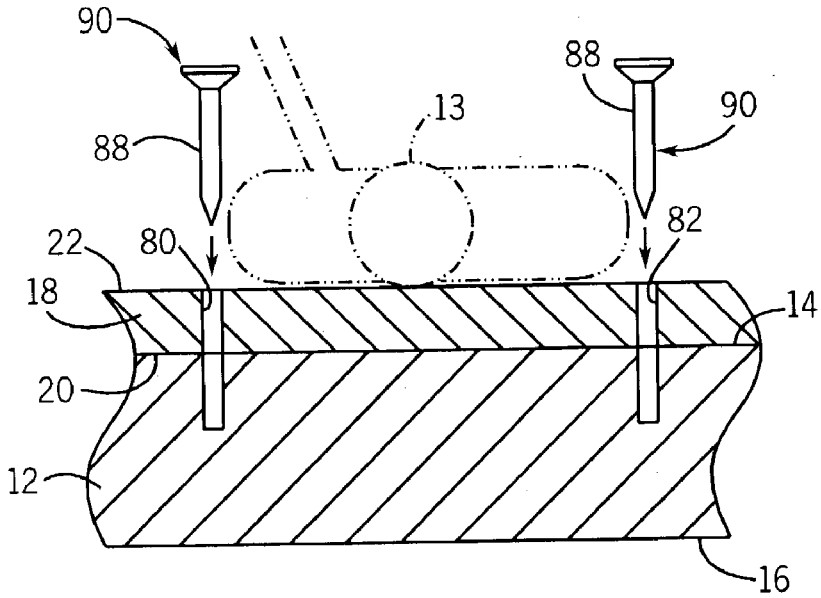
FIG. 5 is an exploded, cross-sectional view of the training device of the present invention taken along line 5—5 of FIG. 4.
Figure 6:
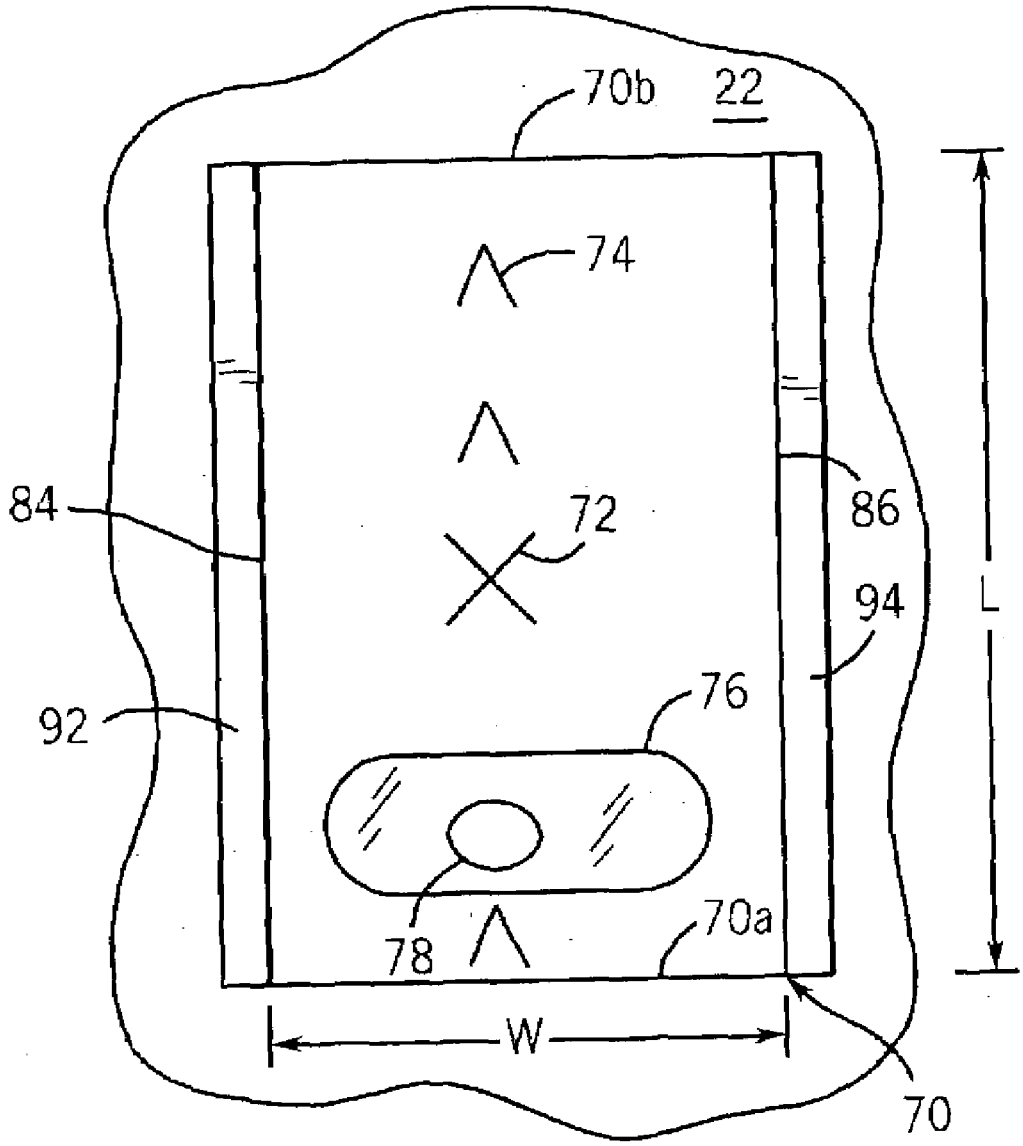
FIG. 6 is a top plan view showing an alternate embodiment of a portion of the training device of the present invention.

As best seen in FIG. 5, tee receiving recesses 80 and 82 extend an upper surface 22 of putting mat 18 into upper surface 14 of base 12. Tee receiving recesses 80 and 82 are positioned on opposite sides 84 and 86, respectively, of tee mat 70 and are adapted for receiving corresponding shafts 88 of conventional golf tees 90. With shafts 88 of golf tees 90 inserted in corresponding tee receiving recesses 80 and 82, golf tees 90 define a gate therebetween for providing a swing path for putter 15 when putting golf ball 13 from ball placement indicia 72 to cup 42. Referring to FIG. 6, it is contemplated to replace tee receiving recesses 80 and 82 with stripes 92 and 94 that extend along the entire length of sides 84 and 86, respectively, of tee mat 70 so as to define the proper swing path necessary to putt golf ball 13 from ball placement indicia 72 to cup 42 using putter 15. Roll path indicia 96 may be provided on upper surface 22 of putting mat 18 between ball placement indicia 72 on tee matt 70 to cup 42 to provide a visual representation of the roll path on which golf ball 13 travels between ball placement indicia 72 and cup 42.

In operation, a user stands on upper surface 22 of putting surface 18 and aligns putter 15 such that ball striking surface 15*a* is positioned behind golf ball 13. The user bends over golf ball 13 such that the user sees a reflection of their eye in the reflecting portion 78 of reflecting surface 76. In such position, the user's eyes are properly positioned behind golf ball 13 over the intended roll path for golf ball 13. As described, the head of the user is in proper position relative to the desired beginning of the roll path and at a correct angle to putting mat 18 for putting. Putter 15 is drawn back to a backswing position wherein the rearward surface 15*d* of putter 15 is generally co-planar with rear edge 70*a* of tee mat 70. The putter 15 is brought forwardly such that ball striking surface 15*a* engages golf ball 13 and urges golf ball 13 along a roll path visually represented by roll path indicia 96 on upper surface 22 of putting mat 18. It is intended that putter 15 travel along a swing path that passes between tees 90 in tee receiving recesses 80 and 82 or between stripes 92 and 94 along sides 84 and 86, respectively, of tee mat 70, depending upon the configuration of training device 10. The follow through of the putting stroke terminates at a location wherein ball striking surface 15*a* of putter 15 is generally co-planar with forward edge 70*b* of tee box 70. By repeatedly putting golf ball 13 from ball placement indicia 72 to cup 42, a user will develop a repeatable, generally pendulum-like putting stroke.

It is contemplated as being the scope of the present invention to provide a plurality of training devices 10 having alternate contours 32, 34 and 36, cup positions and tee box placements on upper surfaces 22 of corresponding putting mats 18 so as to allow a user to develop the skills of reading the correct and accurate line of a putt in relation to the distance of a putt, the speed of the putting surface, and the contours in the putting surface. In addition, it is contemplated that multiple users play a game using multiple training devices 10. Each user could be allowed to putt on each training device 10 in succession and the total of number of putts made would be calculated. Alternatively, as in regular golf, the number of putting strokes required for each player to putt their golf ball 13 in each cup 42 would be recorded. Players would compete for the best score on an individual training device 10 or on a collection of training devices 10. It is further contemplated that each training device could have a par rating. The par rating would increase with the placement of cup insert 58 within cup 42 thereby making it more difficult for a user to putt golf ball 13 into golf ball receiving void 68 within cup insert 58.

Various modes of carrying out the invention are contemplated as being within the scope of the following claims particularly pointing and distinctly claiming the subject matter which is regarded as the invention.

We claim:

1. A training device for teaching the putting of a golf ball comprising:

a spherical golf ball having an equator and an outer surface;

a putter having a head including a surface and a ball striking surface defined by a length and a width;

a first set of circumferentially spaced directional indicia extending about the entire outer surface of said golf ball along said equator;

a second set of linearly spaced directional indicia extending in a single direction along the surface of said putter, wherein the directional indicia on the golf ball and the directional indicia on the surface of the golf club are configured to form a generally linear visual representation of the direction of a golf swing for striking the golf ball with the putter;

a putting surface having an opening therein for receiving the golf ball, the opening having a predetermined diameter;

a tee box on the putting surface, the tee box having a ball placement indicia for positioning the golf ball thereon and a predetermined length;

a pad positioned under the putting surface to provide a contour in the putting surface, the contour having an upslope and a downslope;

upslope indicia on the upslope of the contour of the putting surface visually representing a projected roll path of said golf ball putted from said ball placement indicia, including a visual representation of the deviation of at least the direction of said roll path due to said upslope; and downslope indicia on the downslope of the contour of the putting surface visually representing a projected roll path of said golf ball putted from said ball placement indicia, including a visual representation of the deviation of at least the direction of said roll path due to said downslope.

2. The training device of claim 1 wherein the putting surface includes first and second tee receiving openings positioned on opposite sides of the tee box and wherein the training device further comprises tees receivable in corresponding tee receiving openings for defining a putter path therebetween.

3. The training device of claim 1 further comprising a cup insert receivable in the opening in the putting surface and having an outer diameter generally equal to the diameter of the opening in the putting surface, the cup insert defining a cup opening for receiving the golf ball therein.

4. The training device of claim 1 further comprising a reflective surface affixed to the tee box at a location axial spaced from the placement indicia by a predetermined length.

5. The training device of claim 1 further comprising a plurality of roll path indicia on the putting surface spaced from said ball placement indicia for defining visual representation of a projected roll path for the golf ball between the ball placement indicia and the opening in the putting surface.

6. The training device of claim 1 wherein the tee box includes first and second sides and wherein the training device includes first and second stripes on the putting surface along corresponding sides of the tee box.

7. The training device of claim 1 wherein the putting surface includes an outer periphery and wherein the training device includes a border extending along at least a portion of the outer periphery of the putting surface to maintain the golf ball thereon.

8. A training device for teaching the putting of a golf ball with a putter, comprising:

a spherical golf ball having an equator and an outer surface, said golf ball having a set of circumferentially spaced directional indicia extending about the entire outer surface of said golf ball along said equator;

a putter having a head including a surface and a ball striking surface defined by a length and a width, said putter having a set of linearly spaced directional indicia extending in a single direction along the surface of said putter, wherein the directional indicia on the golf ball and the directional indicia on the surface of the golf club are configured to form a generally linear visual representation of the direction of a golf swing for striking the golf ball with the putter;

a putting surface including:

a contour having an upslope and a downslope; and an opening therein for receiving the golf ball, the opening having a predetermined diameter;

a tee box on the putting surface, the tee box having a ball placement indicia for positioning the golf ball thereon, a predetermined length, and a predetermined width; and a plurality of roll path indicia on the putting surface at spaced locations between the ball placement indicia and the opening, the plurality of roll path indicia visually representing a projected roll path for the golf ball between the ball placement indicia and the opening in the putting surface, including indicia on said contour visually representing the deviation of said roll path due to said contour.

9. The training device of claim 8 further comprising a cup insert receivable in the opening in the putting surface and having an outer diameter generally equal to the diameter of the opening in the putting surface, the cup insert defining a cup opening for receiving the golf ball therein.

10. The training device of claim 8 further comprising upslope indicia on the upslope of the contour of the putting surface arid downslope indicia on the downslope of the contour of the putting surface.

11. A training device for putting a golf ball with a putter, comprising:

a spherical golf ball having an equator and an outer surface, said golf ball having a set of circumferentially spaced directional indicia extending about the entire outer surface of said golf ball along said equator;

a putter having a head including a surface and a ball striking surface defined by a length and a width, said putter having a set of linearly spaced directional indicia extending in a single direction along the surface of said putter, wherein the directional indicia on the golf ball and the directional indicia on the surface of the golf club are configured to form a generally linear visual representation of the direction of a golf swing for striking the golf ball with the putter;

a putting mat, said putting mat including contours forming at least one upslope and one downslope thereon, said putting mat including an opening;

a tee mat on said putting mat marking the starting position for a roll path of said golf ball along said putting mat; and roll path indicia on said putting mat, said roll path indicia spaced from said tee mat visually representing a projected roll path of said golf ball putted from said tee mat, including indicia on said contours visually representing the deviation of said roll path due to said contours.

12. The training device of claim 11 wherein said roll path indicia include a visual representation of the projected direction of a golf ball putted along said roll path.

13. The training device of claim 12 wherein said visual representation of projected direction includes a directional arrow.

14. The training device of claim 11 wherein said roll path indicia are spaced from one another, with closer spacing indicating an upslope and wider spacing indicating a downslope along said roll path.

15. The training device of claim 11 further comprising a tee box having first and second sides and a length generally equal to a desired length of a stroke of the putter necessary to putt the golf ball from said tee mat into said opening.

16. The training device of claim 11 further comprising a tee box having first and second sides spaced to approximately the width of said putter head and a length generally equal to a desired length of a stroke of the putter necessary to putt the golf ball from said tee mat into said opening.

17. The training device of claim 11 further comprising:

ball placement indicia on said tee mat marking the placement location of a golf bail; and a reflective surface affixed to the tee mat at a location spaced from said ball placement indicia.

18. A training device for putting a golf ball with a putter, comprising:

a spherical golf ball having an equator and an outer surface, said golf ball having a set of circumferentially spaced directional indicia extending about the entire outer surface of said golf ball along said equator;

a putter having a head including a surface and a ball striking surface defined by a length and a width, said putter having a set of linearly spaced directional indicia extending in a single direction along the surface of said putter, wherein the directional indicia on the golf ball and the directional indicia on the surface of the golf club are configured to form a generally linear visual representation of the direction of a golf swing for striking the golf ball with the putter;

a putting mat, said putting mat including contours forming at least one upslope and one downslope thereon, said putting mat including an opening;

a tee mat on said putting mat marking the starting position for a roll path of said golf ball along said putting mat; and roll path indicia on said putting mat, said roll path indicia spaced from said tee mat visually representing a roll path of said golf ball putted from said tee mat, including upslope indicia on said at least one upslope and downslope indicia on said at least one downslope visually representing the deviation of said roll path due to said upslope and downslope, respectively.

19. The training device of claim 18 wherein said roll path indicia include a visual representation of the projected direction of a golf ball putted along said roll path.

20. The training device of claim 19 wherein said visual representation of projected direction includes a directional arrow.

21. The training device of claim 18 wherein said roll path indicia are spaced from one another, with closer spacing indicating an upslope and wider spacing indicating a downslope along said roll path.

22. The training device of claim 18 further comprising a tee box having first and second sides and a length generally equal to a desired length of a stroke of the putter necessary to putt the golf ball from said tee mat into said opening.

23. The training device of claim 18 further comprising a tee box having first and second sides spaced to approximately the width of said putter head and a length generally equal to a desired length of a stroke of the putter necessary to putt the golf ball from said tee mat into said opening.

24. The training device of claim 18 further comprising:

ball placement indicia on said tee mat marking the placement location of a golf ball; and a reflective surface affixed to the tee mat at a location spaced from said ball placement indicia.

* * * * *